US007015846B2

(12) United States Patent
Lin

(10) Patent No.: US 7,015,846 B2
(45) Date of Patent: Mar. 21, 2006

(54) CONSTANT CURRENT SOURCE WITH THRESHOLD VOLTAGE AND CHANNEL LENGTH MODULATION COMPENSATION

(75) Inventor: Chun Wei Lin, Changhua (CN)

(73) Assignee: Spirox Corporation, Hsinchu (TW)

( * ) Notice: Subject to any disclaimer, the term of this patent is extended or adjusted under 35 U.S.C. 154(b) by 0 days.

(21) Appl. No.: 10/919,372

(22) Filed: Aug. 17, 2004

(65) Prior Publication Data

US 2005/0046407 A1 Mar. 3, 2005

(30) Foreign Application Priority Data

Aug. 27, 2003 (CN) ..... 92123608 A

(51) Int. Cl.
*G05F 3/16* (2006.01)

(52) U.S. Cl. ..... 341/144; 327/530; 326/68

(58) Field of Classification Search ..... 341/144; 327/530, 563; 326/68, 83
See application file for complete search history.

(56) References Cited

U.S. PATENT DOCUMENTS

| | | | | |
|---|---|---|---|---|
| 5,936,392 A * | 8/1999 | Taylor | 323/315 |
| 6,081,131 A * | 6/2000 | Ishii | 326/68 |
| 6,587,000 B1 * | 7/2003 | Oikawa | 330/288 |
| 6,657,485 B1 * | 12/2003 | Kimura | 327/563 |
| 6,906,651 B1 * | 6/2005 | Yang et al. | 341/144 |

OTHER PUBLICATIONS

"Compensation current source device with a threshold voltage," TW 230284/Mar. 16, 1994.
Chin and Wy: A 10-b 125-MHz CMOS Digital-To-Analog Converter (DAC) with Threshold-Voltage Compensated Current Sources, IEEE Journal of Solid-State Circuits, vol. 29, No. 11, Nov. 1994, pp. 1377-1380.

* cited by examiner

*Primary Examiner*—Bao Q. Vu
(74) *Attorney, Agent, or Firm*—Volentine Francos & Whitt, PLLC

(57) ABSTRACT

A constant current source with threshold voltage and channel length modulation comprises a set of cascade transistors and a compensation circuit electrically connected to the set of cascade transistors so as to form a feedback circuit, in which the set of cascade transistors including a first MOS transistor and a second MOS transistor, and the compensation circuit comprises a third MOS transistor, a fourth MOS transistor, a sixth MOS transistor and a seventh MOS transistor. The gate terminal of the third MOS transistor is connected to the gate terminal of the second MOS transistor. The fourth MOS transistor is connected to the third MOS transistor in serial, and the gate terminal of the fourth MOS transistor is connected to the gate terminal of the first MOS transistor, and the second terminal of the fourth MOS transistor is connected to a current-supplying circuit. The gate terminals of the sixth and seventh MOS transistors are electrically connected to the current-supplying circuit, and a current is generated by mirroring flows through the third MOS transistor.

8 Claims, 7 Drawing Sheets

CONSTANT CURRENT SOURCE WITH THRESHOLD VOLTAGE AND CHANNEL LENGTH MODULATION COMPENSATION

BACKGROUND OF THE INVENTION (A) Field of the Invention

The present invention relates to a constant current source with threshold voltage and channel length modulation compensation, and more particularly to a current source that is applicable to digital-to-analog converter (DAC).

(B) Description of the Related Art

DAC is the most commonly used circuit in integrated circuit (IC) design fields, and can usually be categorized into active component type and passive component type. Passive DAC applies resistors or capacitors to complete such a circuit design. Because the passive components have a larger chip thereon, the matching between these passive components has to be taken into consideration. Furthermore, they need to be accompanied with high-efficiency operational amplifiers to have a good performance, so most current circuit designs do not adopt passive components and tend to adopt active components.

The active components generally can be divided into weighted current source, current cell matrix and switched-current modes in the design field of the DAC circuit. All of the above three modes of the active components have current sources formed by a plurality of current source cells, and make use of some switch components to switch current source cells so as to have various signal conversions.

As shown in FIG. 1, a circuit diagram of a conventional 10-digit DAC, the circuit adopts binary-weighted current source for a design mode. The DAC includes 1023 current source cells 11 and ten weighted current source $I_0$, $2I_1$, $4I_0$, . . . , and $512I_0$ formed by current source cells 11. The output signal can obtain 10-digit resolution by controlling the ten switches 12.

However, because the aforementioned circuit makes use of more than one thousand current source cells 11, the homogeneities of the current source cells 11 output current are very important; otherwise, it is impossible to obtain a DAC with a high resolution or high yield ratio.

FIG. 2 is a circuit diagram of a conventional current source cell. The output current $I_1$ of a current source cell 20 can be formulated by the following formula:

$$I_1 = K_1 \frac{W_1}{L_1}(V_a - V_{th})^2 \quad \text{(Formula 1)}$$

wherein $K_1=\mu_n Cox/2$, $\mu_n$ is electron mobility, Cox is the capacitor value of the unit area, $W_1$ is the channel width of a Metal Oxide Semiconductor (MOS) transistor M1, $L_1$ is the channel length of the MOS transistor M1, Va is the bias voltage of the gate terminal and $V_{th}$ is the threshold voltage.

From Formula 1, current $I_1$ is variable with the threshold voltage $V_{th}$ of the MOS transistor M1, so it is unacceptable for a high resolution DAC. In addition, not only the threshold voltage $V_{th}$ may shift with the manufacture process conditions, but also the great current source cells of a DAC may have a poor PSRR (Power Supply Rejection Ratio; PSRR), which results in a distorted conversion.

To obtain a DAC with a better PSRR, another current source cell 30 is disclosed by Taiwan Patent No.230,284, as shown in FIG. 3. The output current $I_2$ of the current source cell 30 can be simplified into the following formula:

$$I_2 = K_2 \frac{W_2}{L_2}(V_{R1})^2(1 + \lambda V_{DS2}) \quad \text{(Formula 2)}$$

wherein $K_2$ is a constant coefficient same in physical meaning as $K_1$ in Formula 1, $W_2$ is the channel width of MOS transistor M2, $L_2$ is the channel length of a MOS transistor M2, $V_{R1}$ is a first reference voltage; $V_{DS2}$ is the relative voltage between the base electrode and source electrode of the MOS transistor M2, and λ is a coefficient and the whole term (1+λVDS2) expresses the effect of channel length modulation.

Referring to the formula 2, because $V_{R1}$ is a constant value, the output current $I_2$ is in proportion to $V_{DS2}$. However, $V_{DS2}$ is also variable with the variance of the threshold voltage $V_{th}$ of the MOS transistor M1. Compared with the current source cell 20 in FIG. 2, the relation between output current $I_2$ and $V_{th}$ is rewritten in the power of one from the power of two, so the PSRR of the current source cell 30 is likely to be slightly improved.

However, the current source cell 30 in FIG. 3 still cannot meet the requirements of a high resolution DAC. Therefore, a current source with a lower PSRR is progressively demanded for a DAC field to solve all aforementioned disadvantages in DAC.

SUMMARY OF THE INVENTION

The first objective of the present invention is to provide a constant current source with threshold voltage and channel length modulation compensation. A compensation circuit is added in the circuit of a current source cell, and enables a robustness performance in a whole current source that possesses a superior PSRR.

The second objective of the invention is to provide a current source with optimal circuit design. By adjusting corresponding parameters to minimize the variance of an output current, the current source can be widely applied in the DAC circuit design.

In order to achieve these objectives, the present invention discloses a constant current source with threshold voltage and channel length modulation, which includes a first MOS transistor, a second MOS transistor, a third MOS transistor, a fourth MOS transistor and a fifth MOS transistor. Each of the MOS transistors has a gate terminal, a first terminal and a second terminal. The first terminal of the second MOS transistor is coupled to a loading impedance, and its second terminal is coupled to the first terminal of the first MOS transistor. The gate terminal and the first terminal of the third MOS transistor are coupled together to the gate terminal of the second MOS transistor, and its second terminal is coupled to the first terminal of the fourth MOS transistor. The gate terminal and first terminal of the fourth MOS transistor are coupled to the gate terminal of the first MOS transistor, and its second terminal is coupled to a first reference voltage. The gate terminal and second terminal of the fifth MOS transistor are respectively coupled to a second reference voltage and a third reference voltage, and its first terminal is coupled to the gate terminal and first terminal of the third MOS transistor.

The above-mentioned constant current source uses three reference voltages for current compensation, which is controlled by voltage mode. Moreover, a constant current source using current mode is also revealed here to meet specific requirements.

A constant current source with threshold voltage and channel length modulation, using current mode, comprises a first MOS transistor, a second MOS transistor, a third MOS transistor, a fourth MOS transistor, a sixth MOS transistor and a seventh MOS transistor, among which the first, second and third MOS transistors are essentially equivalent to the above design of voltage mode, i.e., those transistors and the above ones are of the substantially same circuits. The fourth MOS transistor has a gate terminal, a first terminal and a second terminal, wherein the gate terminal and the first terminal are electrically connected to the gate terminal of the first MOS transistor and the second terminal of the third MOS transistor, whereas the second terminal is electrically connected to a current-supplying circuit. The sixth MOS transistor has a gate terminal, a first terminal and a second terminal, wherein the gate terminal is electrically connected to the current-supplying circuit, whereas the second terminal is electrically connected to the first terminal of the third MOS transistor and the gate terminal of the second MOS transistor. The seventh MOS transistor has a gate terminal, a first terminal and a second terminal, wherein the gate terminal and the first terminal is connected to the current-supplying circuit, whereas the second terminal is connected to the first terminal of the sixth MOS transistor. A current is generated between the third and sixth MOS transistors by the current-supplying circuit, and the current is self-compensated to be constant.

Through the design of the current mode, multiple constant current sources with threshold voltage and channel length modulation compensation can be applied to specific requirements, for instance, a binary-weighted current source or a DAC, with a view to overcoming the problem of insufficient driving force. In addition, the current is insensitive to temperature, and therefore the influence of variation of process or power can be diminished.

BRIEF DESCRIPTION OF THE DRAWINGS

The invention will be described according to the appended drawings in which.

PREFERRED EMBODIMENT OF THE PRESENT INVENTION

Figure 1:
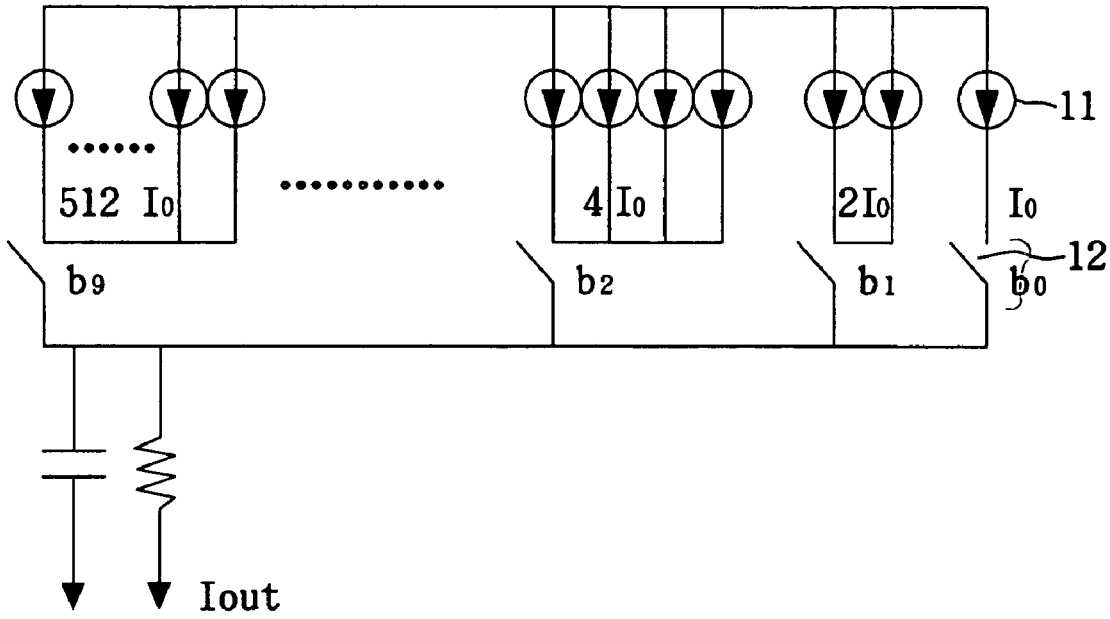
FIG. 1 (Background Art)
FIG. 1 is a circuit diagram of a conventional 10-digit DAC.
Figure 2:
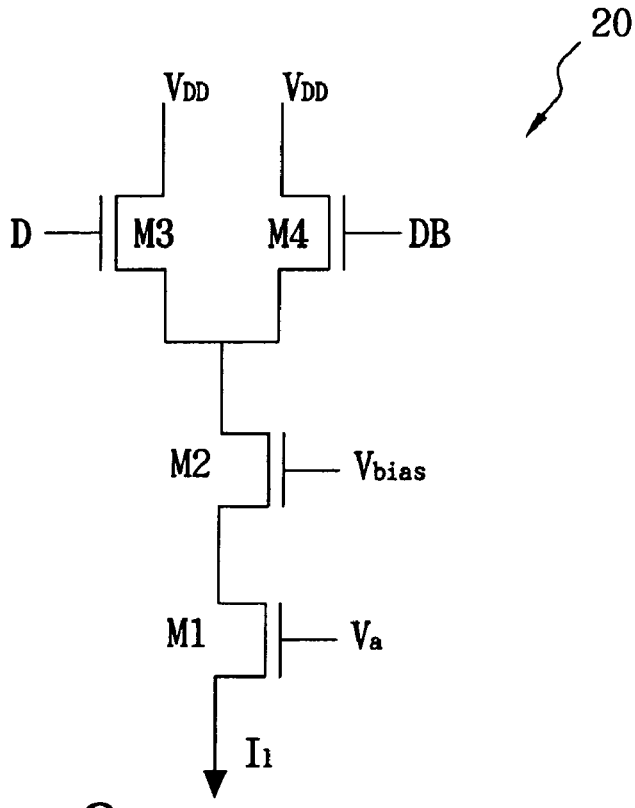
FIG. 2 (Background Art)
FIG. 2 is a circuit diagram of a conventional current source cell.
Figure 3:
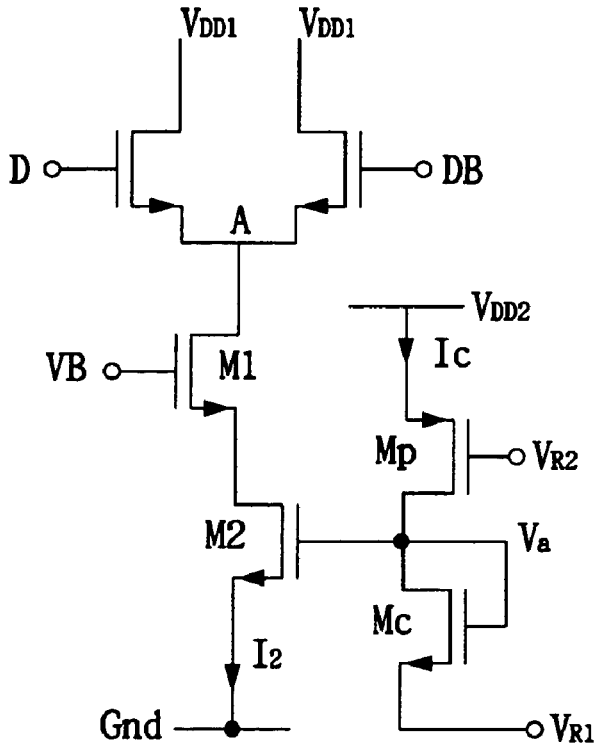
FIG. 3 (Background Art)
FIG. 3 is another circuit diagram of a conventional current source cell.
Figure 4:
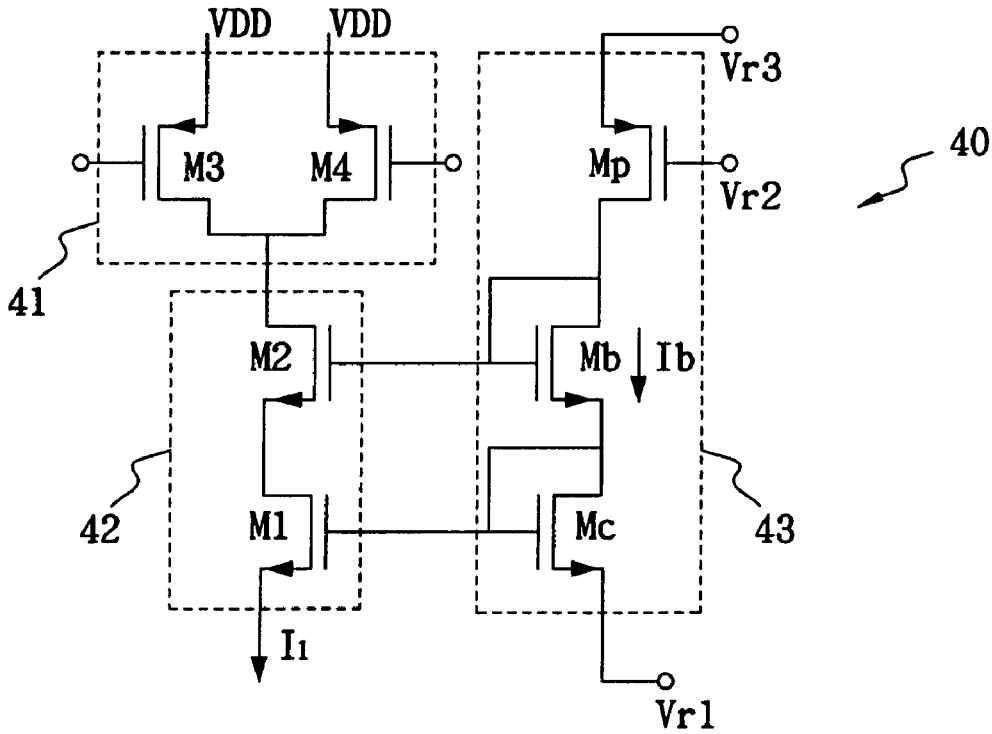
FIG. 4 is a circuit diagram of a current source cell of the first embodiment in accordance with the present invention.

FIG. 4 is a circuit diagram of a current source cell in accordance with the present invention. The current source cell 40 of the present invention includes a first MOS transistor M1, a second MOS transistor M2, a third MOS transistor Mb, a fourth MOS transistor Mc and a fifth MOS transistor Mp. In addition, a MOS transistor M3 and a MOS transistor M4 can be added to the circuit as a switch circuit 41 that can control the direction of an input current. Furthermore, the voltage VDD of the first power supply is together coupled to the source electrodes of the P-type MOS transistor M3 and MOS transistor M4. The first MOS transistor MI and the second MOS transistor M2 form a set of cascade transistors 42. The third MOS transistor Mb, the fourth MOS transistor Mc and the fifth MOS transistor Mp form a compensation circuit 43 that can reduce the influences of threshold voltage of the set of cascade transistors 42 on the output current $I_1$.

The drain electrode of the second MOS transistor M2 is coupled to the drain electrode of the P-type switch circuit 41. The gate terminal and drain electrode of the third transistor Mb are connected with each other to form a diode, and all are together coupled to the gate terminal of the second MOS transistor M2. The gate terminal of the fourth MOS transistor Mc is coupled to its drain electrode to form a diode, and is also coupled with the gate terminal of the fourth MOS transistor M1. The fourth MOS transistor Mc, the third MOS transistor Mb and the fifth MOS transistor Mp of the compensation circuit 43 are connected in a series to form a reference current $I_b$. The source electrode of fourth MOS transistor Mc is coupled to a first reference voltage Vr1, while the gate terminal and source electrode of the fifth transistor Mp are respectively coupled to the second reference voltage Vr2 and the third reference voltage Vr3.

The first MOS transistor M1, the second MOS transistor M2, the third MOS transistor Mb, the fourth MOS transistor Mc and the fifth MOS transistor Mp can be N-type MOS transistors (N channel) or P-type MOS transistors (P channel). However, if the polarities of the MOS transistors in FIG. 4 are changed, the connections of the source electrode and the drain electrode should interchange, and the polarity of the bias voltage applied on a gate terminal should also be changed. To simplify all relative descriptions, the drain electrode and the source electrode of each MOS transistor is defined as a first terminal and a second terminal, respectively. The definitions of the first terminal and the second terminal depend on the polarities of the MOS transistor that is adopted.

In order to obtain the optimal compensation result of the threshold voltage and the channel length modulation on the cell current source 40, the transistor parameters can be controlled during the manufacture process to reach desired physical characteristics. First, the threshold voltage $V_{th2}$ of the second MOS transistor M2 should be decreased to be as low as possible, and the threshold voltages of the second MOS transistor M2 and the third transistor Mb should be kept in consistency ($V_{thb}=V_{th2}$). On the other hand, if the threshold voltages $V_{th2}$ and $V_{thb}$ are decreased, the current Ib passing through the channel of third transistor Mb becomes larger. The fifth transistor Mp can be regarded as a resistor with constant resistance. The bias voltage $V_b$ applied on the gate terminal of the third transistor Mb is decreased, when the current Ib becomes larger. Finally, the decrease of bias-voltage $V_b$ can result in the decrease of bias-voltage $V_{GS2}$ between the gate terminal and second terminal of the second MOS transistor M2, and a predetermined compensation effect is achieved this way.

In other words, the present invention has a feedback circuit formed by the third MOS transistor Mb and the fourth MOS transistor Mc of the compensation circuit 43 and the first MOS transistor M1 and the second MOS transistor M2 of the cascaded transistor 42 to achieve a low PSRR function.

Output current $I_1$ can be formulated by the following formula:

$$I_1 = K_1 \frac{W_1}{L_1}(V_{r1})^2(1 + \lambda V_{DS1}) \quad \text{(Formula 3)}$$

wherein $K_1$ is a constant as the same physical meaning as $K_1$ in formula 1, $W_1$ is the channel width of the first MOS transistor M1, $L_1$ is the channel length of the MOS transistor M1, $V_{r1}$ is the first reference voltage; $V_{DS1}$ is the relative voltage between the drain electrode and source electrode of the first MOS transistor M1, $\lambda$ is a coefficient and the whole term $(1+\lambda V_{DS1})$ expresses the effect of the channel length modulation.

The $V_{DS1}$ can be denoted by the following formula:

$$\begin{aligned} V_{DS1} &= V_b - V_{th2} - V_{OD2} \quad \text{(Formula 4)} \\ &= V_{r3} - k_b(V_{GSb} - V_{thb})^2 \times R_{on} - V_{th2} - V_{OD2} \\ &= -k_b R_{on} V_{th2}^2 + (2 \times k_b V_{GSb} R_{on} - 1) \times V_{th2} + V_{R3} - \\ &\quad k_b R_{on} V_{GSb}^2 - V_{OD2} \\ &= V_{th2}^2 - \left(2V_{GSb} - \frac{1}{k_b R_{on}}\right)V_{th2} + V_{GSb}^2 - V_{OD2} \end{aligned}$$

wherein $V_{th2}$ is the threshold voltage of the second MOS transistor M2, $V_{OD2}$ ($V_{OD2}=V_{GS2}-V_{th2}$) is the over-driving voltage of the second MOS transistor M2, $K_b$ is the parameter of the third MOS transistor Mb, $V_{GSb}$ is the bias voltage between the gate terminal and second terminal of the third MOS transistor Mb and $R_{on}$ is the equivalent resistance of the fifth MOS transistor Mp.

Formula 4 is finally simplified as the quadratic parabolic curve of the $V_{th2}$ and $V_{DS1}$, and the most insensitive design range of $V_{DS1}$ to $Vth_2$ can be obtained through the quadratic parabolic curve. It is determined by $$\frac{\partial V_{DS1}}{\partial V_{th2}} = 0 \Rightarrow V_{th2}(V_{DS1'\min}) = V_{GSb} - \frac{1}{2k_b R_{on}}$$

wherein $V_{th2}(V_{DS1,min})$ is the corresponding value of $V_{th}$ when VDS1 is a minimum.

Figure 5:
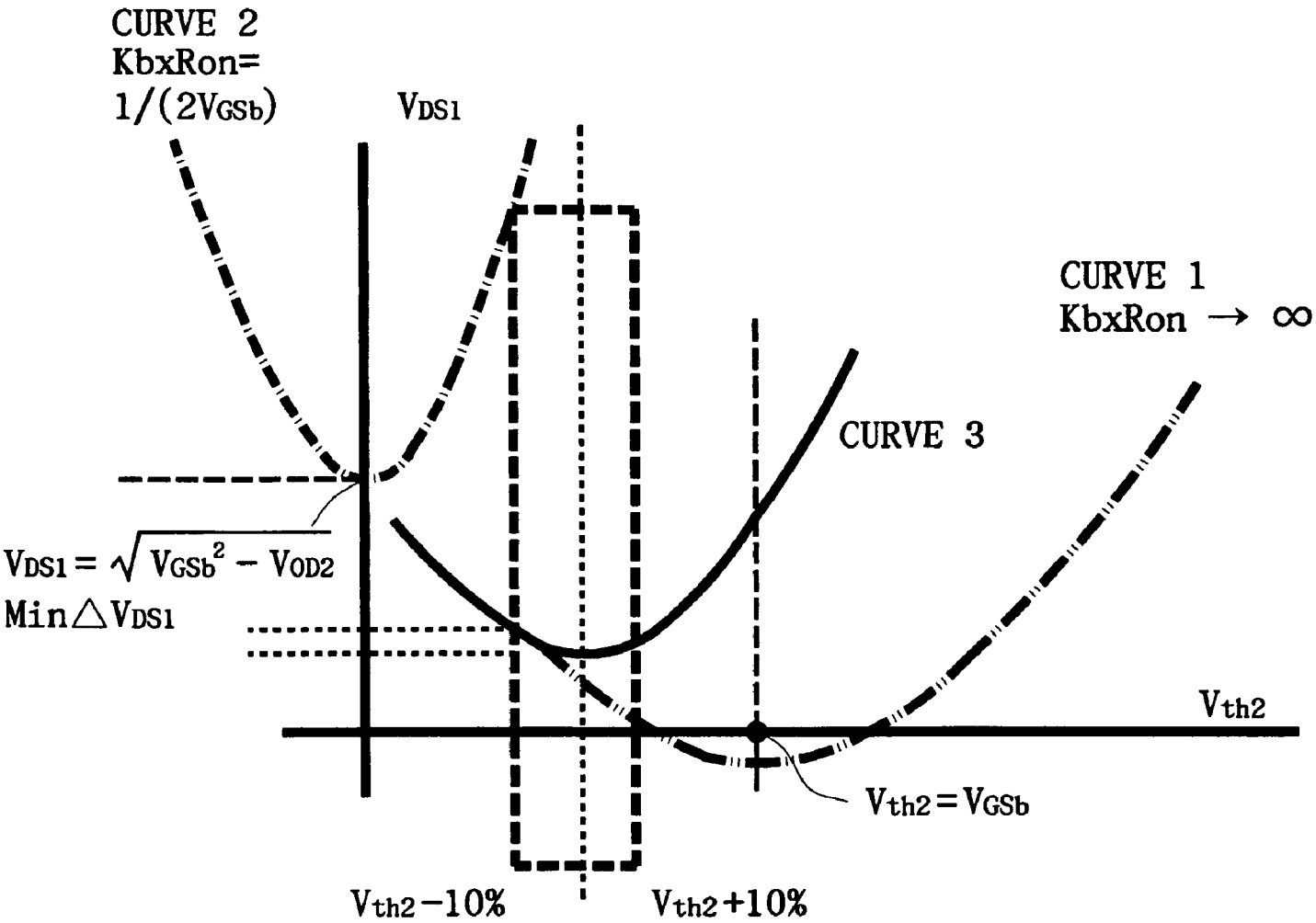
FIG. 5 shows quadratic curves of Formula 4 in accordance with the present invention.

FIG. 5 shows quadratic curves of formula 4 in accordance with the present invention. Curve 1 represents the relation between $V_{DS1}$ and $V_{th2}$ when the compound parameter $K_b \times R_{on}$ approximates infinity. The curve 2 represents the relation between $V_{DS1}$ and $V_{th2}$ when the compound parameter $K_b \times R_{on}$ equals $V_{GSb}/2$. The curve 1 and curve 2 are based on two extra conditions, and a common practical condition is shown as represented by the curve 3. The optimal design is considered to obtain the $K_b \times R_{on}$ value corresponding to the central symmetry point of the curve 3, because even if Vth2 is varied within ±10% around the central symmetry point, the minimal variance of $V_{DS1}$ can be obtained, i.e., MIN $\Delta V_{DS1}$.

The most robust current source cell can be obtained through the above-described optimal design considerations. Then, we can use a computer to further analyze and simulate the performances of the optimal current source cell by a Monte-Carlo method. The simulation conditions can assume that $V_{th1}$, $V_{th2}$, $V_{thb}$, $V_{thc}$ and $V_{thp}$ all have their Gaussian distribution with ±10% (=3σ) variances, and the variable range of the power supply voltage VDD is from 2.7V to 3.9V. Then, we can obtain 0.15% PSRR as a good performance in comparison with conventional technologies.

The above-mentioned current source cell 40 uses three reference voltages for current compensation, which is controlled under voltage mode. When multiple current source cells 40 are employed at the same time, the total required current is larger. For instance, if a current source cell 40 needs 5 microamperes (μA) and is applied to a 10-bit circuit, a current of 5120 μA ($5\times2^{10}$=5120) in total is needed, i.e., approximately 5 milliamperes (mA).

Figure 6:
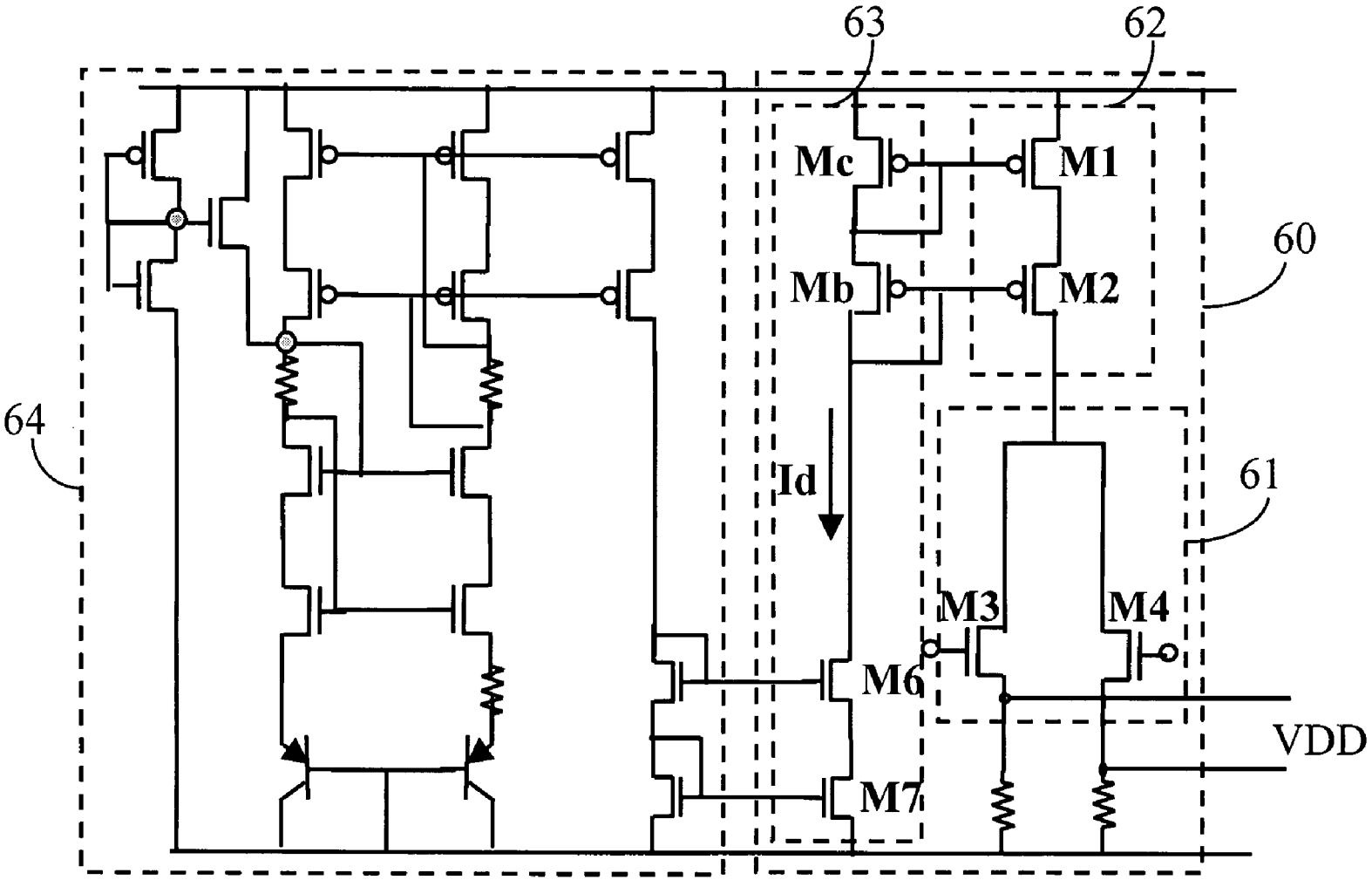
FIG. 6 is a circuit diagram of a current source cell of the second embodiment in accordance with the present invention.

FIG. 6 shows another embodiment of the present invention, in which a current source cell 60 is compensated under current mode. The circuit of the current source cell 60 is similar to that illustrated in FIG. 4, but is upside down and poles of some transistors are opposite to that in FIG. 4, and the fifth MOS transistor Mp in FIG. 4 is replaced with a sixth MOS transistor M6 and a seventh MOS transistor M7. A switch circuit 61 consisted of the MOS transistors M3 and M4 is able to control current direction, and a source voltage VDD is coupled to the sources of the MOS transistors M3 and M4. The first and second MOS transistors M1 and M2 form a set of cascade transistors 62, whereas the third MOS transistor Mb, the fourth MOS transistor Mc, the sixth MOS transistor M6 and the seventh MOS transistor M7 form a compensation circuit 63. The gate terminal and the drain terminal of the third MOS transistor Mb are coupled, so as to function as a type of diode, and the gate terminal of Mb is further coupled to the gate terminal of the second MOS transistor M2. The drain terminal of the second MOS terminal M2 is coupled to the switch circuit 61. The gate terminal of the fourth MOS transistor Mc is coupled to its drain terminal to act as a diode, and is further coupled to the gate terminal of the first MOS transistor M1. The fourth MOS transistor Mc, the third MOS transistor Mb, the sixth MOS transistor M6 and the seventh MOS transistor M7 in the compensation circuit 63 are connected, and the source terminal of the fourth MOS transistor Mc, the gate terminal of the sixth MOS transistor M6 and the gate and source terminals of the seventh MOS transistor M7 are coupled to a current-supplying circuit 64. The current-supplying circuit 64 shown in FIG. 6 is illustrative only, and can be substituted by another essentially equivalent circuit in practice.

Through mapping, the current-supplying circuit 64 can generate a current Id accompanying with a bias voltage between the third MOS transistor Mb and the sixth MOS transistor M6 in the current source cell 60. Accordingly, the effect is equivalent to that of the three reference voltages under voltage mode.

The fourth MOS transistor Mc and the first MOS transistor MI are located at essentially equivalent positions in layout, and thus the threshold voltages of them are almost the same. Therefore, when the threshold voltage of the first MOS transistor MI is decreased, the threshold voltage of the fourth MOS transistor Mc is decreased as well. As a result, the current Id flowing through the third MOS transistor Mb and the sixth MOS transistor M6 is increased. Meanwhile, because the voltages between the gate and source terminals of the sixth and seventh MOS transistors M6 and M7 are not changed, the voltages of the drain terminals of the sixth and seventh MOS transistors M6 and M7 are increased relatively. Accordingly, the bias voltages between the gate and source terminals of the third and fourth MOS transistors Mb and Mc are decreased, and thus the current Id is decreased. In other words, the current source cell 60 has the capability of current stabilization by itself, so it can perform compensation automatically.

In comparison with voltage mode, the case of current mode can automatically adjust current by itself. When multiple current source cells are employed, the current source cell 60 using current mode can overcome the problem of current loss that may occur under voltage mode. Therefore, it is unnecessary to add (an) amplifier(s) in the circuit to provide larger driving capability.

Figure 7:
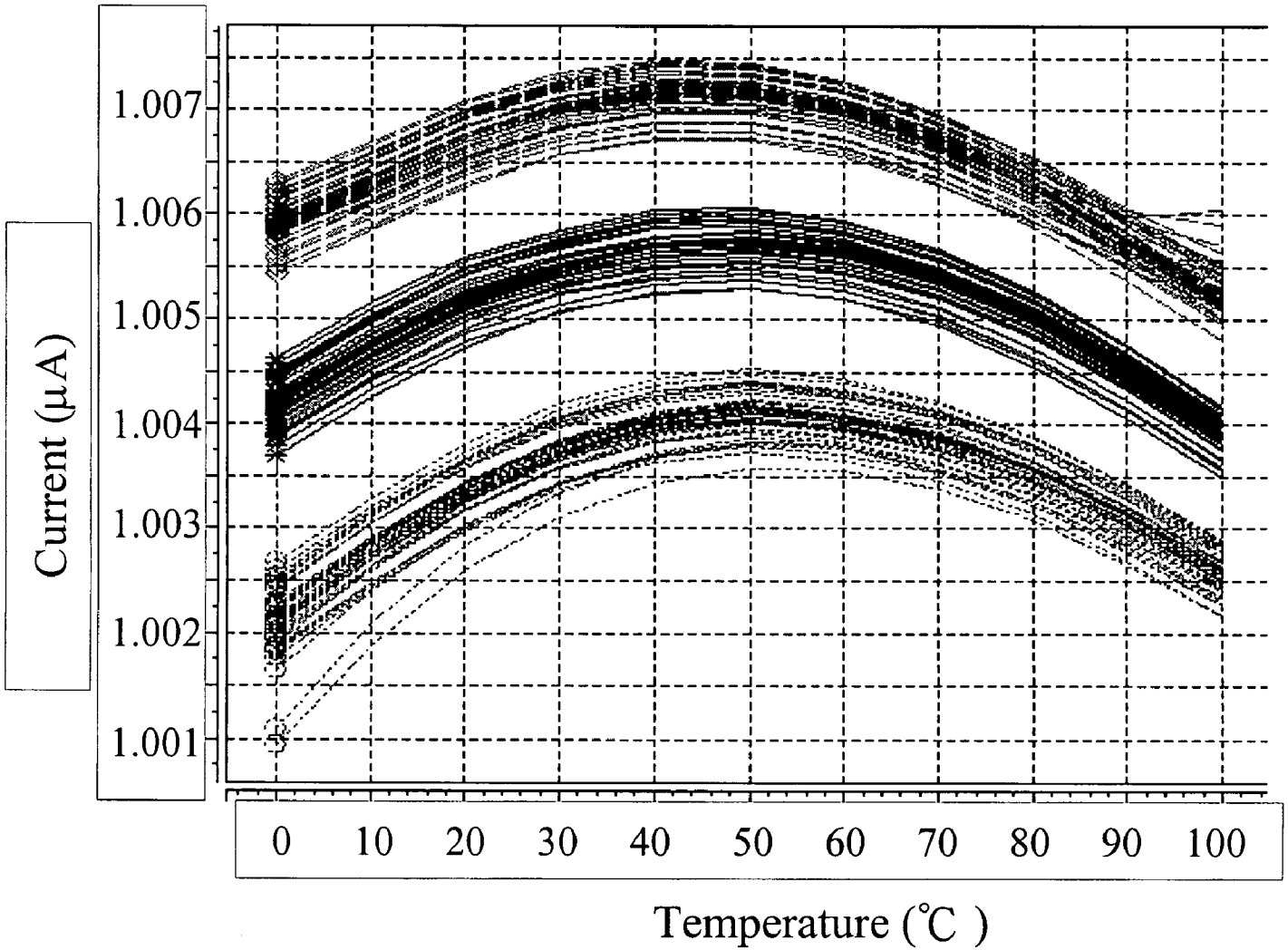
FIG. 7 shows the relation of current and temperature of the current source cell in accordance with the present invention.

Moreover, because the current Id in the current source cell 60 has the capability of compensation, it can be sustained to be constant. In comparison with voltage mode, the current source cell 60 is insensitive to temperature, i.e., having lower temperature coefficient (TC) number. The test result of the current source cell 60 in relation to temperature is shown in FIG. 7, in which the curves are categorized into three groups respectively representing the cases of the VDD of 3.6V, 3.3V and 3V from top to bottom. The current variation of each group within a range of 100° C. is defined as the temperature coefficient. As shown in FIG. 7, the current varies by approximately 0.0024 $\mu$A from 0 to 100° C. in each group, so the temperature coefficient TC=0.0024 $\mu$A/100° C. Apparently, the current source cell 60 has superior stability to temperature. In addition, based on experiments, the entire current variation can be controlled below 0.65% even if the variation of PSRR and various current due to different threshold voltage are added, and thus the interference of the variations of process and power can be effectively diminished.

Figure 8:
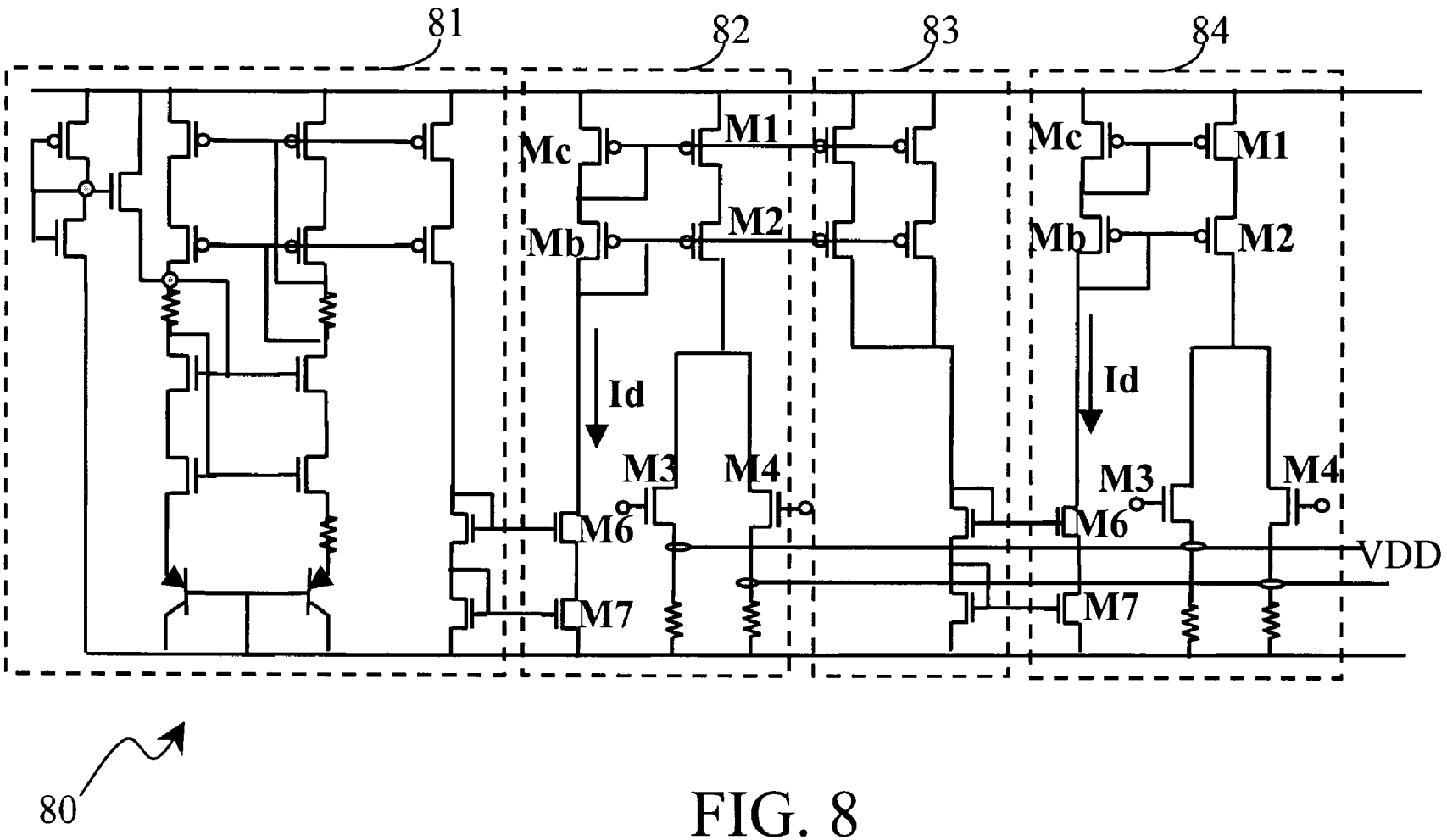
FIG. 8 shows a current cell of the second embodiment applied to a binary-weighted current source.

FIG. 8 shows a binary-weighted current source 80, which employs current source cells of current mode. The binary-weighted current source 80 comprises a first current-supplying circuit 81, a first current source cell 82, a second current-supplying circuit 83 and a second current source cell 84, which are all connected in series. The circuits of the first and second current source cells 82 and 84 are identical or similar to that of the current source cell 60 in FIG. 6. The first current-supplying circuit 81 provides the required current of the first current source cell 82. The output current of the first current source cell 82 flows through the second current-supplying circuit 83 and is transmitted to the second current source cell 84 to provide the required current of the second current source cell 84. Because the current source cells 82 and 84 can perform current compensation by themselves, the output current can be sustained to be constant and the insufficient driving capability problem can be overcome. The binary-weighted current source 80 can generate from one to three times amount of current, depending on different output positions. For instance, the first current source cell 82 is weighted once, and the second current source cell 84 is weighted twice. Therefore, it is unnecessary to make a circuit of triple area, so the cost can be effectively reduced.

Figure 9:
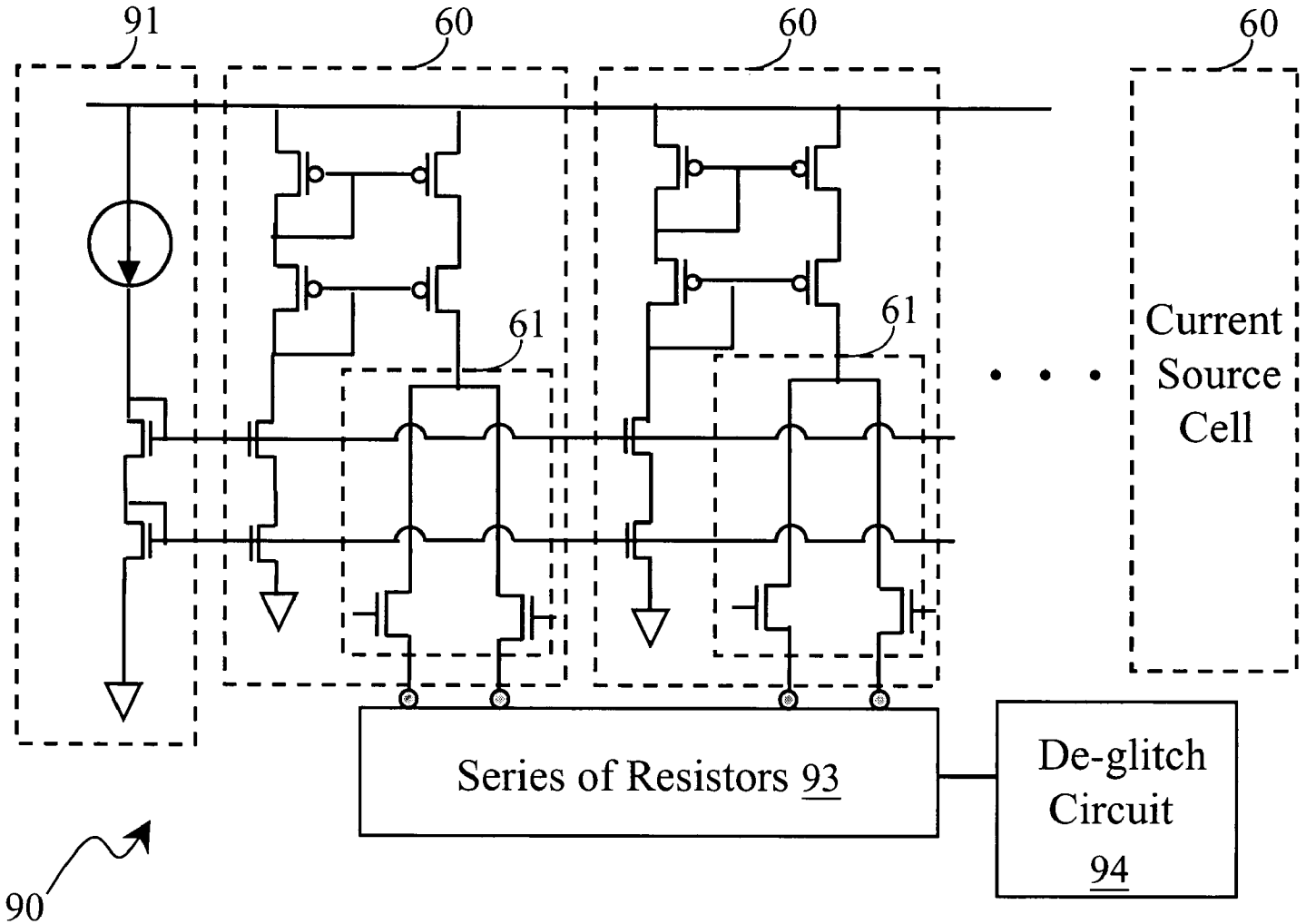
FIG. 9 shows a current cell of the second embodiment applied to a DAC.

FIG. 9 shows the constant current source 60 applied to a DAC, in which a DAC 90 comprises a current-supplying circuit 91, multiple current source cells 60 as shown in FIG. 6, a series of resistors 93 and a de-glitch circuit 94. The switch circuit 61 of each current source cell 60 is connected to the series of resistors 93, whereas an end of the series of resistors 93 is connected to the de-glitch circuit 94. In the case of a 12-bit circuit, 4096 ($2^{12}$) current source cells 60 have to be connected, so as to reach the high transform efficiency.

The above-described embodiments of the present invention are intended to be illustrative only. Numerous alternative embodiments may be devised by persons skilled in the art without departing from the scope of the following claims.

What is claimed is:

1. A constant current source with threshold voltage and channel length modulation, comprising:

a set of cascade transistors including a first MOS transistor and a second MOS transistor; and a compensation circuit electrically connected to the first MOS transistor and the second MOS transistor so as to form a feedback circuit, the compensation circuit comprising:

a third MOS transistor whose gate terminal is connected to a gate terminal of the second MOS transistor;

a fourth MOS transistor connected to the third MOS transistor in serial and having a gate terminal, a first terminal and a second terminal, wherein the gate terminal of the fourth MOS transistor is connected to a gate terminal of the first MOS transistor, and the second terminal of the fourth MOS transistor is connected to a current-supplying circuit; and a fifth MOS transistor and a sixth MOS transistor, wherein the gate terminals of the fifth and sixth MOS transistors are electrically connected to the current-supplying circuit, and current is generated by mirroring flows through the third MOS transistor.

2. The constant current source with threshold voltage and channel length modulation of claim 1, wherein the third and fourth MOS transistors function as a diode.

3. A constant current source with threshold voltage and channel length modulation, comprising:

a first MOS transistor having a gate terminal, a first terminal and a second terminal;

a second MOS transistor having a gate terminal, a first terminal and a second terminal, wherein the second terminal is electrically connected to the first terminal of the first MOS transistor;

a third MOS transistor having a gate terminal, a first terminal and a second terminal, wherein the gate and first terminals are electrically connected to the gate terminal of the second MOS transistor;

a fourth MOS transistor having a gate terminal, a first terminal and a second terminal, wherein the gate terminal and the first terminal are electrically connected to the gate terminal of the first MOS transistor and the second terminal of the third MOS transistor, whereas the second terminal is electrically connected to a current-supplying circuit;

a fifth MOS transistor having a gate terminal, a first terminal and a second terminal, wherein the gate terminal is electrically connected to the current-supplying circuit, and the second terminal is electrically connected to the first terminal of the third MOS transistor; and a sixth MOS transistor having a gate terminal, a first terminal and a second terminal, wherein the gate and first terminals are connected to the current-supplying circuit, and the second terminal is connected to the first terminal of the fifth MOS transistor.

4. The constant current source with threshold voltage and channel length modulation of claim 3, wherein the second terminal of the first MOS transistor is used for outputting current from the constant current source.

5. The constant current source with threshold voltage and channel length modulation of claim 3, wherein the second MOS transistor is electrically connected to a source voltage through a switch circuit.

6. The constant current source with threshold voltage and channel length modulation of claim 5, wherein the switch circuit comprises two MOS transistors, the second terminals of the two MOS transistors are connected to the first terminal of the second MOS transistor, and the first terminals of the two MOS transistors are connected to the source voltage.

7. The constant current source with threshold voltage and channel length modulation of claim 3, which is applied to a binary-weighted current source.

8. The constant current source with threshold voltage and channel length modulation of claim 3, which is applied to a digital-to-analog converter.

* * * * *